US006688389B2

(12) United States Patent
Connell et al.

(10) Patent No.: US 6,688,389 B2
(45) Date of Patent: Feb. 10, 2004

(54) APPARATUS AND METHOD FOR LOCATING JOINTS IN COILED TUBING OPERATIONS

(75) Inventors: Michael L. Connell, Duncan, OK (US); Robert G. Howard, Duncan, OK (US); James C. Tucker, Springer, OK (US); Douglas N. Love, Midland, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 40 days.

(21) Appl. No.: 09/977,168

(22) Filed: Oct. 12, 2001

(65) Prior Publication Data

US 2003/0070806 A1 Apr. 17, 2003

(51) Int. Cl.[7] ..... E21B 47/09
(52) U.S. Cl. ..... 166/255.1; 166/66; 166/316
(58) Field of Search ..... 166/66, 66.5, 255.1, 166/250.01, 271, 308, 311, 66.7, 316, 321, 334.4

(56) References Cited

U.S. PATENT DOCUMENTS

| | | | | |
|---|---|---|---|---|
| 3,941,190 A | | 3/1976 | Conover | 166/187 |
| 4,519,451 A | * | 5/1985 | Gray et al. | 166/278 |
| 4,667,736 A | | 5/1987 | Rumbaugh et al. | 166/65.1 |
| 4,808,925 A | | 2/1989 | Baird | 324/221 |
| 4,911,242 A | | 3/1990 | Hromas et al. | 166/317 |
| 5,234,053 A | | 8/1993 | Connell | 166/250 |
| 5,236,047 A | | 8/1993 | Pringle et al. | 166/369 |
| 5,392,862 A | | 2/1995 | Swearingen | 166/386 |
| 5,429,190 A | | 7/1995 | Kilgore et al. | 166/255 |
| 5,443,129 A | | 8/1995 | Bailey et al. | 175/45 |
| 5,465,787 A | | 11/1995 | Roth | 166/66.4 |
| 5,609,178 A | | 3/1997 | Hennig et al. | 137/10 |
| 5,626,192 A | | 5/1997 | Connell et al. | 166/255.1 |
| 5,873,414 A | | 2/1999 | von Gynz-Rekowski | 166/319 |
| 6,003,834 A | | 12/1999 | Read | 251/30.01 |
| 6,253,842 B1 | | 7/2001 | Connell et al. | 166/66 |
| 6,269,883 B1 | * | 8/2001 | Gissler et al. | 166/340 |
| 6,305,467 B1 | | 10/2001 | Connell et al. | 166/66 |
| 6,394,184 B2 | * | 5/2002 | Tolman et al. | 166/281 |
| 6,464,006 B2 | * | 10/2002 | Womble | 166/276 |

FOREIGN PATENT DOCUMENTS

| | | | |
|---|---|---|---|
| GB | 2 310 444 A | 8/1997 | E21B/47/09 |
| GB | 2 341 197 A | 3/2000 | E21B/47/09 |
| WO | WO 01/14685 A1 | 3/2001 | E21B/4/04 |

OTHER PUBLICATIONS

Nonvolatile Electronics, Inc. Catalog (undated but admitted to be prior art).

* cited by examiner

*Primary Examiner*—Frank S. Tsay

(57) ABSTRACT

An apparatus and method is provided for locating joints in coiled tubing operations. The apparatus is adapted for running into a well on coiled tubing and for use during reverse circulating and fracturing operations. The apparatus having a central passageway for fluids, a collar locator module, a one-way valve coupled to the central passageway to allow for the flow of fluids in one direction but not the other, a port coupled to the central passageway to allow fluids to exit when the one-way valve is functioning, a movable cover module to cover the port to build up pressure in the central passageway, and a flow diverting module for permanently diverting the flow of fluids from the port to the central passageway.

31 Claims, 10 Drawing Sheets

88
70
96
72
92
100a
94a
100b
94b
112a
90
104b
111a
104a
68
78
106
110a
107
108
110b
79
102
114
105a
105b
105c
105d
111b
112b
124
133a
126
133b
134
120
138
118
130

138
130
118
74
96
150
146a
142a
146b
142b
140
144
148
152
98
154
158
166
159
132
156
164
182
184
190a
190b
160
164
162
174
178a
172
161
191
176
178b
186
170
188

290
VBAT
VCC
P1-A
F1
.25A
VIN
VOUT
R1
100K
RESET
U2:A
174
D1
REF
C1
100μF
C2
.22μF
C9
.22μF
C10
.1μF
P1-F
U3:A
VCC
R5
10K
C11
470μF
R4
100K
PR
D
Q
CP
Q̄
CLR
U6:A
VCC
R6
10K
U3:B
U7:A
U3:D
U3:C
U6:B
TO

C13
.1μF
P1:C
GAIN SELECT
P1:H
D2
D3
W2:A
W2:B
W2:C
W2:D
R12
51.1K
D4
D5
R7
100K
R8
10K
R9
6.81K
R10
5.11K
R11
3.32K
VCC
U8:A
U2:D
VCC
R13
10K
TP1
W1:G
R14
100K

APPARATUS AND METHOD FOR LOCATING JOINTS IN COILED TUBING OPERATIONS

BACKGROUND

The present invention relates generally to subterranean pipe string joint locators, and specifically to an apparatus and method for locating joints in coiled tubing operations.

In the drilling and completion of oil and gas wells, a wellbore is drilled into the subterranean producing formation or zone of interest. A string of pipe, e.g., casing, is typically then cemented in the wellbore, and a string of additional pipe, known as production tubing, for conducting produced fluids out of the wellbore is disposed within the cemented string of pipe. The subterranean strings of pipe are each comprised of a plurality of pipe sections which are threadedly joined together. The pipe joints, often referred to as collars, are of an increased mass as compared to other portions of the pipe sections.

After a well has been drilled, completed and placed in production, it is often necessary to service the well using procedures such as perforating, setting plugs, setting cement retainers, spotting permanent packers, reverse circulating fluid and fracturing. Such procedures may be carried out by utilizing coiled tubing. Coiled tubing is a relatively small flexible tubing, usually one to three inches in diameter, which can be stored on a reel when not being used. When used for performing well procedures, the tubing is passed through an injector mechanism, and a well tool is connected to the end of the tubing. The injector mechanism pulls the tubing from the reel, straightens the tubing and injects it through a seal assembly at the wellhead, often referred to as a stuffing box. Typically, the injector mechanism injects thousands of feet of the coiled tubing with the well tool connected at the bottom end into the casing string or the production tubing string of the well. A fluid, most often a liquid such as salt water, brine or a hydrocarbon liquid, is circulated through the coiled tubing for operating the well tool or other purpose. The coiled tubing injector at the surface is used to raise and lower the coiled tubing and the well tool during the service procedure and to remove the coiled tubing and well tool as the tubing is rewound on the reel at the end of the procedure.

During such operations, it is often necessary to precisely locate one or more of the pipe joints of the casing, a liner or the production tubing in the well. This need arises, for example, when it is necessary to precisely locate a well tool, such as a packer, within one of the pipe strings in the wellbore. A joint locator tool may be lowered into the pipe string on a length of coiled tubing, and the depth of a particular pipe joint adjacent to or near the location to which the tool is positioned can be readily found on a previously recorded casing joint or collar log for the well. However, such joint locator tools often do not work well in many oil field operations such as reverse circulating and fracturing. What is needed therefore, is a joint locator tool that can work in reverse circulation or fracturing operations.

DETAILED DESCRIPTION

Figure 1:
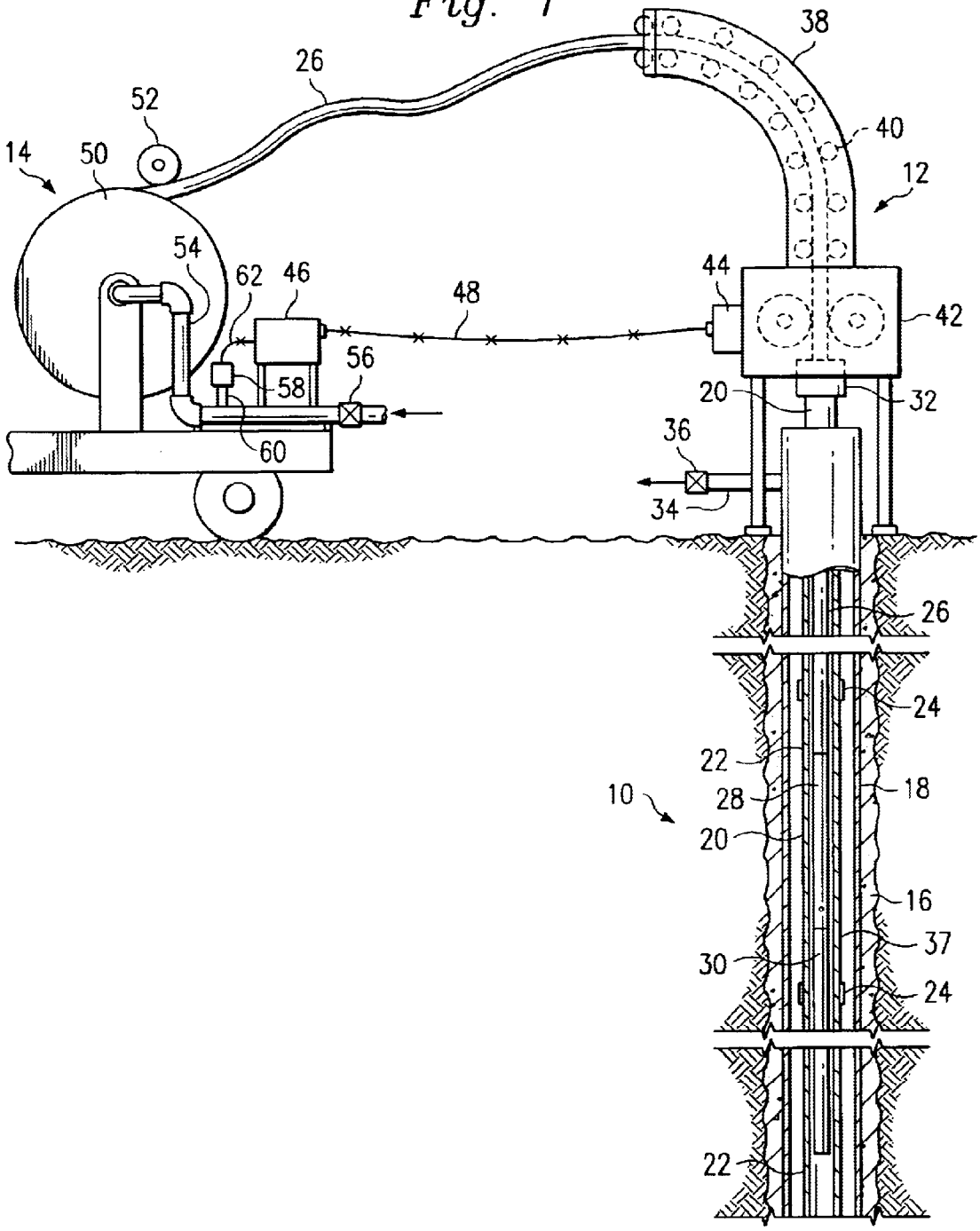
FIG. 1 is a schematic illustration of a cased well having a string of production tubing and a length of coiled tubing.

Referring now to FIG. 1, a well 10 is schematically illustrated along with a coiled tubing injector 12 and a truck mounted coiled tubing reel assembly 14. The well 10 includes a wellbore 16 having a casing string 18 cemented therein in a conventional manner. A string of production tubing or "production string" 20 is also shown installed in well 10 within casing string 18. Production string 20 may be made up of a plurality of tubing sections 22 connected by a plurality of joints or collars 24 in a manner known in the art.

A length of coiled tubing 26 is shown positioned in production string 20. One embodiment of the present invention uses a tubing collar or joint locator which is generally designated by the numeral 28 and is attached to the lower end of the coiled tubing 26. One or more well tools 30 may be attached below the joint locator 28.

The coiled tubing 26 is inserted into the well 10 by the injector 12 through a stuffing box 32 attached to an upper end of the production string 20. The stuffing box 32 functions to provide a seal between the coiled tubing 26 and the production string 20 whereby pressurized fluids within the well 10 are prevented from escaping to the atmosphere. A circulating fluid removal conduit 34 having a shutoff valve 36 therein may be sealingly connected to the top of the casing string 18. Fluid circulated into the well 10 through the coiled tubing 26 is removed from the well 10 through the conduit 34 and a valve 36 and routed to a pit, tank or other fluid accumulator. A coiled tubing annulus 37 may also be defined to be between the coil tubing 26 and the production string 20.

The coiled tubing injector 12 may be of a kind known in the art and functions to straighten the coiled tubing 26 and inject it into the well 10 through the stuffing box 32 as previously mentioned. The coiled tubing injector 12 comprises a straightening mechanism 38 having a plurality of internal guide rollers 40 therein and a coiled tubing drive mechanism 42 which may be used for inserting the coiled tubing 26 into the well 10, raising the coiled tubing 26 or lowering it within the well, and removing the coiled tubing 26 from the well 10 as it is rewound on the reel assembly 14. A depth measuring device 44 is connected to the drive mechanism 42 and functions to continuously measure the length of the coiled tubing 26 within the well 10 and provide that information to an electronic data acquisition system 46 which is part of the reel assembly 14 through an electric transducer (not shown) and an electric cable 48.

The truck mounted reel assembly 14 may include a reel 50 on which the coiled tubing 26 is wound. A guide wheel 52 may also be provided for guiding coiled tubing 26 on and off reel 50. A conduit assembly 54 is connected to the end of coiled tubing 26 on reel 50 by a swivel system (not shown). A shut-off valve 56 is disposed in conduit assembly 54, and the conduit assembly is connected to a fluid pump (not shown) which pumps fluid to be circulated from the pit, tank or other fluid communicator through the conduit assembly and into coiled tubing 26. A fluid pressure sensing device and transducer 58 may be connected to conduit assembly 54 by connection 60, and the pressure sensing device may be connected to data acquisition system 46 by an electric cable 62. As will be understood by those skilled in the art, data acquisition system 46 functions to continuously record the depth of coiled tubing 26 and joint locator 28 attached thereto in the well 10 and also to record the surface pressure of fluid being pumped through the coiled tubing and joint locator as will be further described below.

The basic sections and functional modules of one embodiment of the joint locator 28 will be discussed with reference to FIG. 2. The joint locator 28 has an outer housing 68 which is generally cylindrical in shape and encloses the various modules and components of one embodiment of the present invention. At the upper end of the outer housing 68 is an upper connecting sub 70 which is adapted to be connected to the bottom of the coiled tubing 26. A top opening 71 is concentrically located in the upper connecting sub 70. The top opening 71 defines an end of a first fluid passageway or central throughbore 72 which generally runs through the joint locator 28 along a vertical or longitudinal axis 74.

Positioned below the upper connecting sub 70, and located within the outer housing 68, is a collar locator module 76 which is a module designed to detect location of collars or joints within the well casing. Although a number of technologies could be used, the collar locator module 76 discussed in reference to the illustrative embodiment uses the principal of Faraday induction. Such technology employs a strong magnet to generate a magnetic field and a coil in which a voltage is induced due to the motion of the coil through the magnetic field perturbation caused by the magnetic discontinuity created by a gap between two sections of casing. The gap in the casing indicates the presence of a joint or collar in the casing. The collar locator module 76 may be coupled to a power source, such as a battery pack 78. In the illustrative embodiment, an electronic controller 79 is coupled to the battery pack 78. As will be explained in more detail below, the electronic controller 79 contains the circuits and control chips for determining when the magnetic discontinuity represents a joint and generates an electrical signal in response to such a determination. A coil and magnet section 80, containing a magnet and coil, may be positioned within the outer housing 68 and below the battery pack 78. The coil and magnet section 80 is in electronic communication with the battery pack 78 and the electronic controller 79. Thus, in the illustrative embodiment, the collar locator module 76 comprises the battery pack 78, the electronic controller 79, the coil and magnet section 80, and the associated wiring (not shown) between the components.

A mechanical section 81 may be located within the outer housing 68 and below the coil and magnet section 80. As will be explained in detail below, the mechanical section 81 contains a plurality of fluid passages, valves and ports which mechanically control the fluid flow and, thus operation of the joint locator 28. For instance, a one-way valve is coupled to the interior of the central throughbore 72. In the illustrative embodiment, the one-way valve is a flapper valve 82. However, other forms of one-way valves could be employed. The flapper valve 82, when used in a "backwashing" mode, allows fluid to flow in an upwardly direction through the central throughbore 72. In another operational mode, the flapper valve 82 is normally biased to prevent fluid from flowing in a downwardly direction. Under these conditions, the fluid may exit through a second fluid passage, such as an exit port 83. Under other operational modes, a movable cover module 84 inside the central throughbore 72 operates to block the flow of fluid from entering the exit port 83, resulting in an increase in pressure within the central throughbore 72. Under yet other operating conditions, a separate flow diverting module 85 operates to divert the flow of fluid from the exit port 83 and forces the fluid to flow through the flapper valve 82 and through central throughbore 72.

Figure 3A:
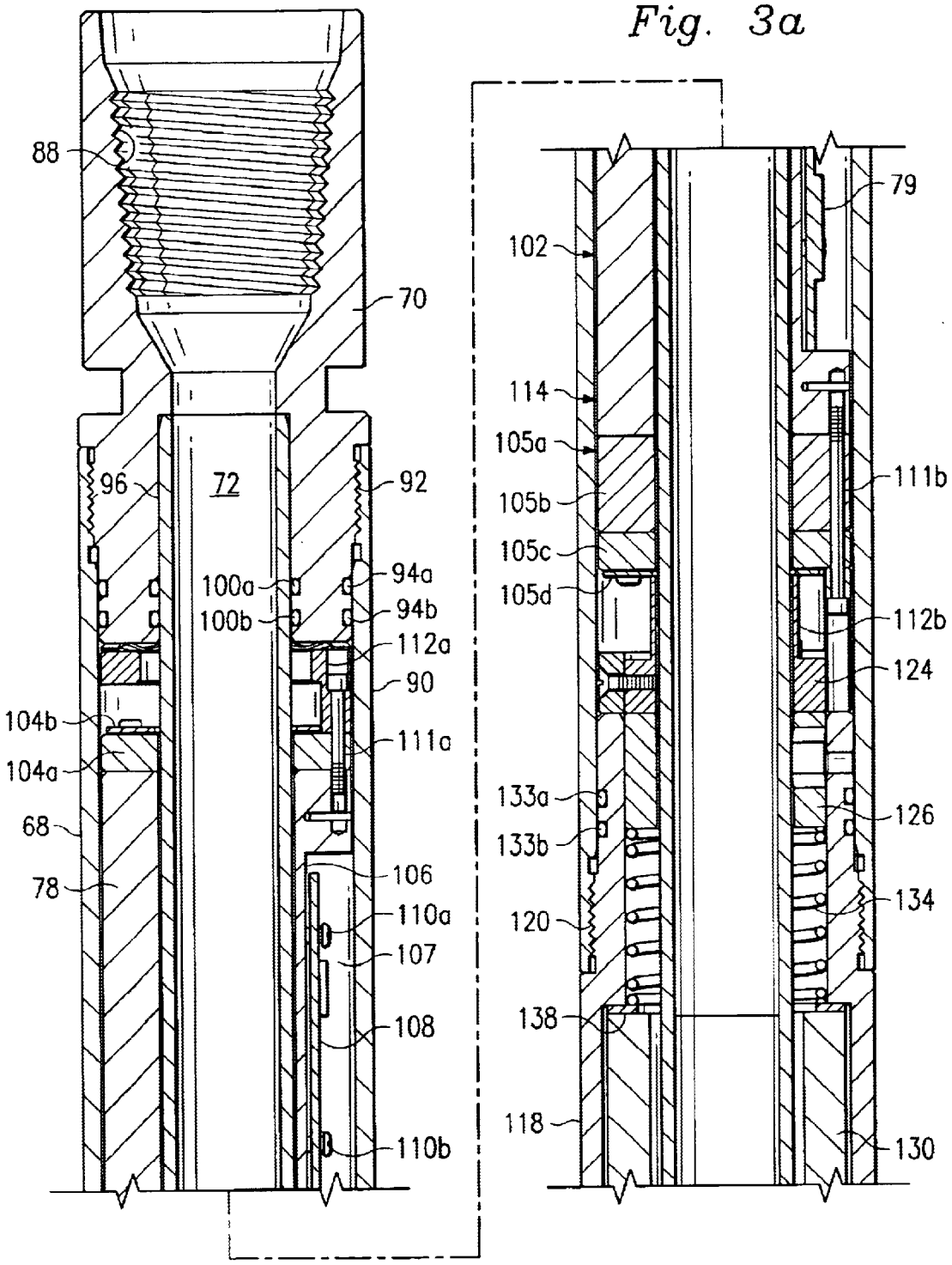
FIG. 3*a* is a longitudinal cross section illustrating the upper one-third of the embodiment illustrated in FIG. 2.

Turning now to FIG. 3*a,* the details of one embodiment will be discussed. As previously discussed, the upper connecting sub 70 may be adapted for connecting to a well string in a conventional manner. For instance, in one embodiment, the upper connecting sub 70 may have a threaded inside surface 88 to connect to a tool string or coiled tubing 26. A lower end of the upper connecting sub 70 may be connected to a cylindrical shaped electronic housing 90 by means of a threaded connection 92. A sealing means, such as a plurality of O-rings 94*a*–94*b* provide a sealing engagement between the upper connecting sub 70 and the electronic housing 90. In the illustrative embodiment, the electronic housing 90 is a subsection of the outer housing 68 and encases the battery pack 78 and the electronic controller 79.

Figure 3B:
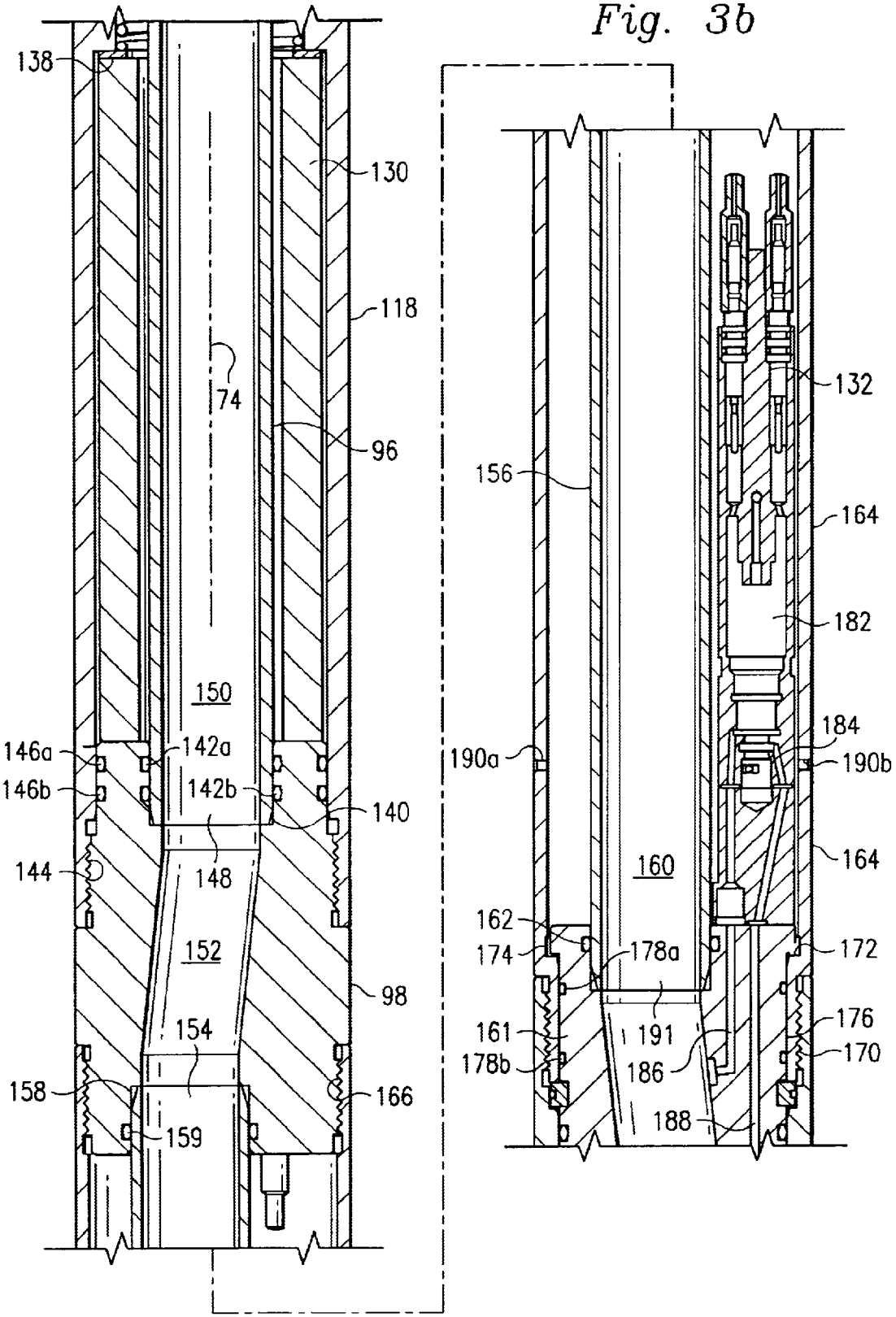
FIG. 3*b* is a longitudinal cross section illustrating the middle one-third of the embodiment illustrated in FIG. 2.

Also coupled to the bottom portion of the upper connecting sub 70 is an upper flow tube 96 running down from the upper connecting sub 70 to an upper transition sub 98 (FIG. 3*b*). The upper flow tube 96 defines a portion of the central throughbore 72. A pair of O-rings 100*a*–100*b* provide a sealing engagement between the flow tube 96 and the upper connecting sub 70.

In the illustrative embodiment, the battery pack 78 is generally cylindrical in shape. The battery pack 78 may comprise a battery housing 102 with a plurality of tubular battery chambers (not shown). At an upper end of the battery housing 102 is a battery pack cap assembly 104*a* which may contain a separate waferboard 104*b,* or in alternative embodiments contain integrated power leads. In the illustrative embodiment, the waferboard 104*b* may contain power leads from each battery chamber so that each battery chamber may be connected in a conventional manner. An electric power source, such as a plurality of batteries may be disposed in each battery chamber. In the illustrative embodiment, there are eight battery chambers with four batteries in each chamber and each battery is an AA size battery At the lower end of the battery housing 102 is a lower end cap assembly 105*a* containing a spring housing 105*b,* a lower end cap 105*c,* and waferboard 105*d.* The spring housing contains a spring (not shown) to bias the batteries in a conventional manner so the proper electrical connections are made between the batteries and the end caps.

An outer surface 106 of the battery housing 102 is flat to create a space 107 for the electronic controller 79 (FIG. 2), which in one embodiment, may be a printed circuit board (PCB) 108. The printed circuit board 108 may be attached to the surface 106 by means of a plurality of screws 110*a* and 110*b.* The details of the printed circuit board 108 are discussed below in reference to FIG. 4.

A top screw 111*a* may be used to connect a top spacer 112*a* to the various components of the battery pack cap assembly 104*a* and to the battery back housing 102. Similarly a bottom screw 111*b* may be used to connect a bottom spacer 112*b* to the various components of the lower end cap assembly 105*a* and to the battery pack housing 102. Thus, the battery pack cap assembly 104*a,* battery housing 102, and lower end cap assembly 105*a* may form a single electric case 114 which houses the printed circuit board 108 and the power source. The electric case 114 may then be easily removed from electronic housing 90 by disconnecting the upper connecting sub 70 and sliding the electric case 114 out over the upper flow tube 96. This provides easy battery replacement and facilitates replacement or reconfiguration of the printed circuit board 108.

A contact insulator 124 may be disposed below the electrical case 114. The contact insulator 124 houses a plurality of probe contacts (not shown). A probe housing 126 is positioned below the contact insulator 124 and houses a plurality of probes (not shown) corresponding to the probe contacts. A set of probes and corresponding probe contacts allow for an electrical connection between the printed circuit board 108 and an electromagnetic coil assembly 130. A set of wires (not shown) run between the probe contacts and the printed circuit board 108. Another set of wires (not shown) also run between the other set of probes and the electromagnetic coil assembly 130. Thus, when the probes are in contact with the probe contacts, an electrical connection may be formed between the printed circuit board 108 and the electromagnetic coil assembly 130 via the other set of probes, the corresponding probe contacts, and the associated wiring. Since the probes, probe contacts and associated wires are conventional, they will not be described in further detail.

Similarly, another set of probes and the corresponding probe contacts allow for an electrical connection between the printed circuit board 108 and a solenoid valve assembly 132 (FIG. 3*b*). A set of wires (not shown) run between the probe contacts and the printed circuit board 108. Another set of wires (not shown) also run between the probes and the solenoid valve assembly 132. Thus, when the probes are in contact with the probe contacts, an electrical connection may be formed between the printed circuit board 108 and the solenoid valve assembly 132 via the probes, the corresponding probe contacts, and the associated wiring.

In the illustrative embodiment, a lower end of the electronic housing 90 is coupled to a generally cylindrical coil housing 118 by a threaded connection 120. The coil housing 118 is also a subsection of the outer housing 68. A plurality of O-rings 133*a*–133*b* provide for a seal between the electronic housing 90 and the coil housing 118. A spring 134 may be positioned between the probe housing 126 and a washer 138 in the coil housing 118 to provide a biasing means for biasing the probes and contact probes upwardly. It will be seen by those skilled in the art that biasing in this manner will keep each probe contact in electrical contact with the corresponding probe. In this way, the proper electrical connection is made between the printed circuit board 108 and the electromagnetic coil assembly 130 and also with the solenoid valve assembly 132.

Turning now to FIG. 3*b,* the electromagnetic coil assembly 130 is positioned in coil housing 118 below the washer 138. In the illustrated embodiment, the electromagnetic coil assembly 130 is of a kind generally known in the art having a coil, magnets and rubber shock absorbers (not shown). The electromagnetic coil assembly 130, the battery pack 78, the printed circuit board 108 and the probes are part of the collar locator module 76 used in the illustrative embodiment.

As seen in FIGS. 3*a* and 3*b,* the upper flow tube 96 extends downwardly from the upper connecting sub 70 to the upper transition sub 98, where it is coupled to the upper transition sub 98. A sealing means such as plurality of O-rings 142*a* and 142*b* provide a sealing engagement between the upper transition sub 98 and the upper flow tube 96. In the illustrative embodiment, the coil housing 118 is also connected to the upper transition sub 98 by means of a threaded connection 144. A plurality of O-rings 146*a* and 146*b* provide a sealing engagement between the coil housing 118 and the upper transition sub 98.

A bore 148 is axially located in the upper transition sub 98. The bore 148 forms a portion of the throughbore 72 and is in communication with the interior of the upper flow tube 96. The bore 148 has a top portion 150 which is substantially axially centered along the vertical axis 74 of the joint locator 28. The bore 148 also has an angularly disposed central portion 152 connecting to a longitudinally extending lower portion 154. Thus, lower portion 154 of bore 148 is off center with respect to the top portion 150 and the central axis of joint locator 28.

A lower flow tube 156 extends into the lower portion 154 of the bore 148 and connects to the upper transition sub 98. A sealing means, such as an O-ring 159, provides sealing engagement between the lower flow tube 156 and the upper transition sub 98. The bottom end of lower flow tube 156 extends into a bore 160 in a lower transition housing 161. A sealing means, such as an O-ring 162, provides sealing engagement between the lower flow tube 156 and the lower transition housing 161.

A solenoid valve housing 164, which is a sub-component of the outer housing 68, may be positioned below the upper transition sub 98. The solenoid valve housing 164 may be coupled to the upper transition sub 98 by means of a threaded connection 166. Although in the illustrative embodiment, the solenoid valve housing 164 is generally cylindrical, the bottom portion 170 of the solenoid valve housing 164 is stepped radially inwardly to create a seat 172. An upper rim 174 of the lower transition housing 161 fits on the seat 172. Thus, the bottom portion 170 of the solenoid valve housing 164 surrounds an exterior surface 176 of the lower transition housing 161 to create a threaded connection with the solenoid valve housing 164. A sealing means, such as a plurality of O-rings 178*a* and 178*b* provides a sealing engagement between the solenoid valve housing 164 and the lower transition housing 161.

The solenoid valve assembly 132, which may be disposed within the solenoid valve housing 164, may be of a kind known in the art having an electric solenoid 182 which actuates a valve portion 184. The solenoid valve assembly 132 may be adapted for coupling to fluid passageways 186 and 188 in the lower transition housing 161. The solenoid valve assembly 132 may also be adapted for connecting to a plurality of vent ports 190*a* and 190*b,* which are disposed in the solenoid valve housing 164. The solenoid valve assembly 132 may be configured and positioned so that when it is in a closed position, communication between the passageway 186 and passageway 188 is prevented. In this situation, passageway 188 is in communication with vent ports 190*a* and 190*b.* When solenoid valve assembly 132 is in the open position, the passageway 186 and the passageway 188 are placed in communication with one another, and the passageway 188 is no longer in communication with the vent ports 190*a* and 190*b.*

Figure 3C:
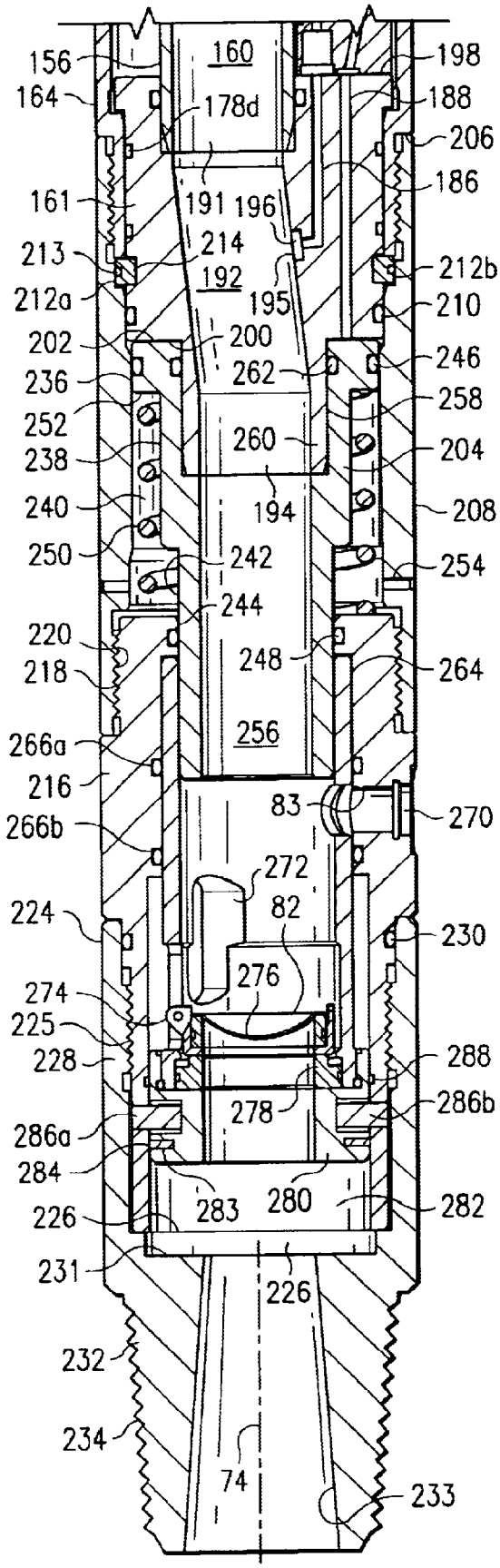
FIG. 3*c* is a longitudinal cross section illustrating the lower one-third of the embodiment illustrated in FIG. 2.

As shown in FIG. 3C, the bore 160 is part of the central throughbore 72 and is in communication with the interior of the lower flow tube 156. The bore 160 has a top portion 191 which extends longitudinally to an angularly disposed central portion 192. The central portion 192 connects to a substantially axially centered lower portion 194. Thus, the top portion 191 of bore 160 is off center with respect to the lower portion 194 and the central axis 74 of illustrated embodiment.

As previously discussed, the lower transitional housing 161 has the passageway 186 extending between an opening 195 on the inside surface of the central portion 192 and an upper surface 198. A screen 196 covers the opening 195 to prevent the passageway 186 from becoming clogged. The passageway 188 extends between the upper surface 198 and a lower surface 200 of the lower transitional housing 161. The lower end of the passageway 188 is in communication with a top surface 202 of a piston 204. As will be explained in reference to the operation, when the passageway 188 is in fluid communication with the central throughbore 72 via the solenoid valve assembly 132, fluid flows down the passageway 188 exerting a pressure on the top surface 202 of the piston 204.

The solenoid valve housing 164 is stepped radially inwardly to form an external shoulder 206. A piston housing 208 is positioned below the external shoulder 206 and may be threadedly attached to the solenoid valve housing 164. The piston housing 208 is a subcomponent of the outer housing 68. A sealing means, such as an O-ring 210, provides sealing engagement between the solenoid valve housing 164 and the piston housing 208. A split ring assembly having two split ring halves 212*a* and 212*b* fits in a groove 214 defined on the outside of lower transition housing sub 161. It will be seen by those skilled in the art that split ring assembly thus acts to lock the lower transition housing sub 161 with respect to solenoid valve housing 164. An O-ring 213 may be used to hold the halves 212*a* and 212*b* of the split ring in the groove 214 during assembly.

A circulating sub 216, which is generally cylindrical in shape, is disposed below the piston housing 208. The circulating sub 216 has a threaded exterior surface 218 to connect to the threaded interior surface 220 of the piston housing 208.

A bottom sub housing 224 is disposed below the circulating sub 216. In the illustrated embodiment, the bottom sub housing 224 is generally cylindrical in shape and has a threaded interior surface 225 to couple to an exterior threaded surface 228 of the circulating sub 216. A sealing means, such as an O-ring 230, may be used to provide a seal between the circulating sub 216 and the bottom sub housing 224. The bottom sub housing 224 has an abrupt narrowing of the interior bore 226 to create a seat 231. A bottom portion 232 of the bottom sub housing 224, may be adapted to be coupled to another well tool in a conventional manner. For instance, the bottom portion has an opening 233 to accept well fluids from other well tools. In some embodiments, the exterior of the bottom portion 232 is tapered and has an exterior threaded surface 234 to connect to other well tools.

The piston 204 is slidably disposed within the piston housing 208. The piston 204 is stepped to form a first outside diameter 236 and a second outside diameter 238 to create spring chamber 240 disposed within the piston housing 208. In the illustrative embodiment, the piston 204 also has a third diameter 242 which will fit within a top bore 244 of the circulating sub 216. A sealing means, such as O-ring 246 provides sealing engagement between the piston 204 and the piston housing 208. Another sealing means, such as O-ring 248, provides sealing engagement between the piston 204 and the circulating sub 216.

A biasing means, such as spring 250 is positioned between a downwardly facing shoulder 252 on the piston 204 and an upper end of the circulating sub 216. In the illustrative embodiment, the spring 250 biases the piston 204 upwardly towards the lower surface 200 of the lower transition housing sub 161. A vent port 254 is located within the wall of the piston housing 208 to equalize the pressure between spring chamber 240 and the well annulus 37 (FIG. 1). It will be seen by those skilled in the art that, when in use, the well annulus pressure is thus applied to the area of the shoulder 252 on the piston 204. It will also be seen that the top surface 202 of the piston 204 is in communication with the passageway 188 of the lower transition housing sub 161.

The piston 204 is hollow having a first bore 256 therein and a larger second bore 258. The first bore 256 is part of central throughbore 72. A cylindrical neck 260 of the lower transition housing sub 161 extends into the second bore 258. A sealing means, such as an O-ring 262, provides sealing engagement between piston 204 and neck 260.

A cylindrical flapper sleeve 264 fits within a concentric bore of the circulating sub 216. A sealing means, such as a pair of O-rings 266*a* and 266*b*, provides a seal between the flapper sleeve 264 and the circulating sub 216. The transverse exit port 83 runs through a wall of the circulating sub 216 and the flapper sleeve 264. A nozzle 270 may be threaded into the exit port 83 to control the flow of fluid exiting through the exit port 83. In the position of piston 204 shown in FIG. 3*c*, the piston 204 is disposed above the exit port 83. In this position, fluid moving down the central throughbore 72 may exit through the exit port 83.

Figure 5A:
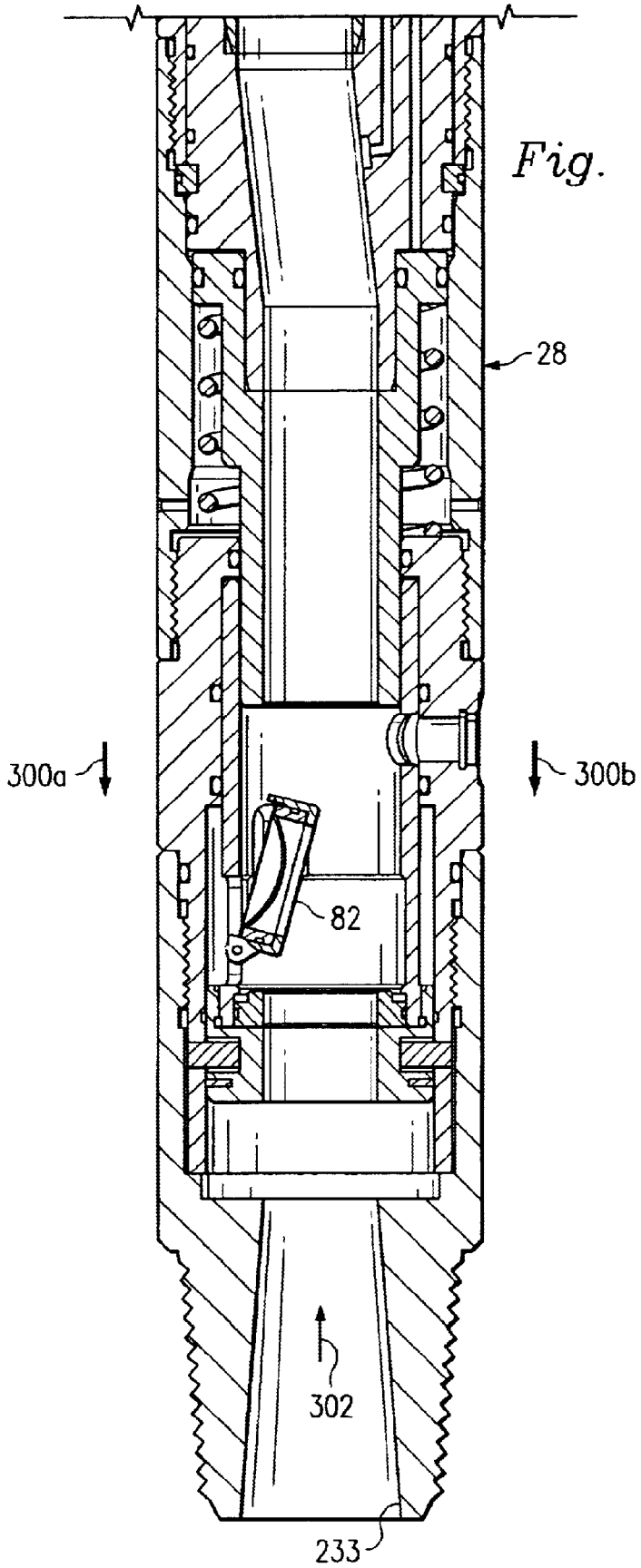
FIG. 5*a* is a longitudinal cross section of the embodiment illustrated in FIG. 3*c* showing the embodiment functioning in a reverse circulation mode.

As discussed previously in reference to FIG. 2, a one-way valve, such as a flapper valve or flapper 82 is hingedly coupled to the inside of the flapper sleeve 264. In the illustrative embodiment, a pair of elongated slots 272 (only one of which is shown in FIG. 3*c*), is defined in the wall of the flapper sleeve 264 to allow the flapper 82 to swing about a hinge 274 from a horizontal position to a substantially vertical position, as shown in FIG. 5A. A biasing means, such as a spring (not shown) surrounding a hinge pin of hinge 274 may bias the flapper 82 in a closed position. The flapper 82 may be a hollow cylinder enclosing a rupture disk 276. The function of the rupture disk 276 will be discussed below in reference to the operation.

In the illustrative embodiment, a flapper seat 278 provides a seat for the flapper when the flapper is in the horizontal position. The flapper seat is disposed within a flapper seal retainer 280. The flapper seal retainer 280 is generally cylindrical in shape and is disposed within a central bore 282 of the circulating sub 216. A sealing means, such as an O-ring 288, provides sealing engagement between the flapper seal retainer 280 and the circulating sub 216. A groove 283 runs along the lower exterior surface of the flapper seal retainer 280. A snap ring 284 fits within the groove 283. The flapper seal retainer 280 may be vertically retained in place with respect to the circulating sub 216 by a shearing mechanism, such as shear pins 286*a* and 286*b*.

Figures 4A, 4B:
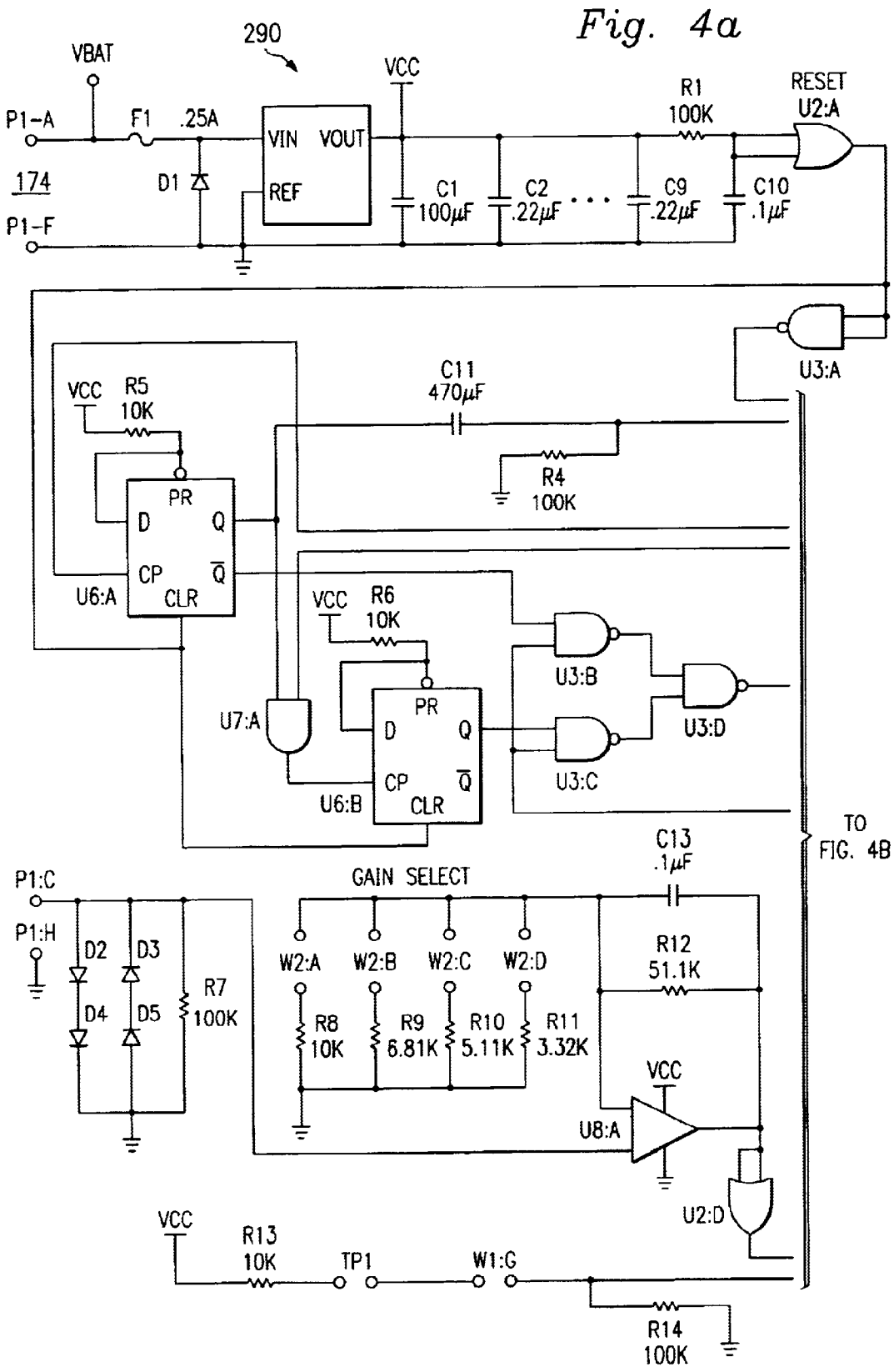
FIG. 4*a* illustrates a portion of a wiring schematic for a printed circuit board which may be used in one embodiment of the present invention.
FIG. 4*b* illustrates a portion of a wiring schematic for a printed circuit board which may be used in one embodiment of the present invention.
Figure 4B:
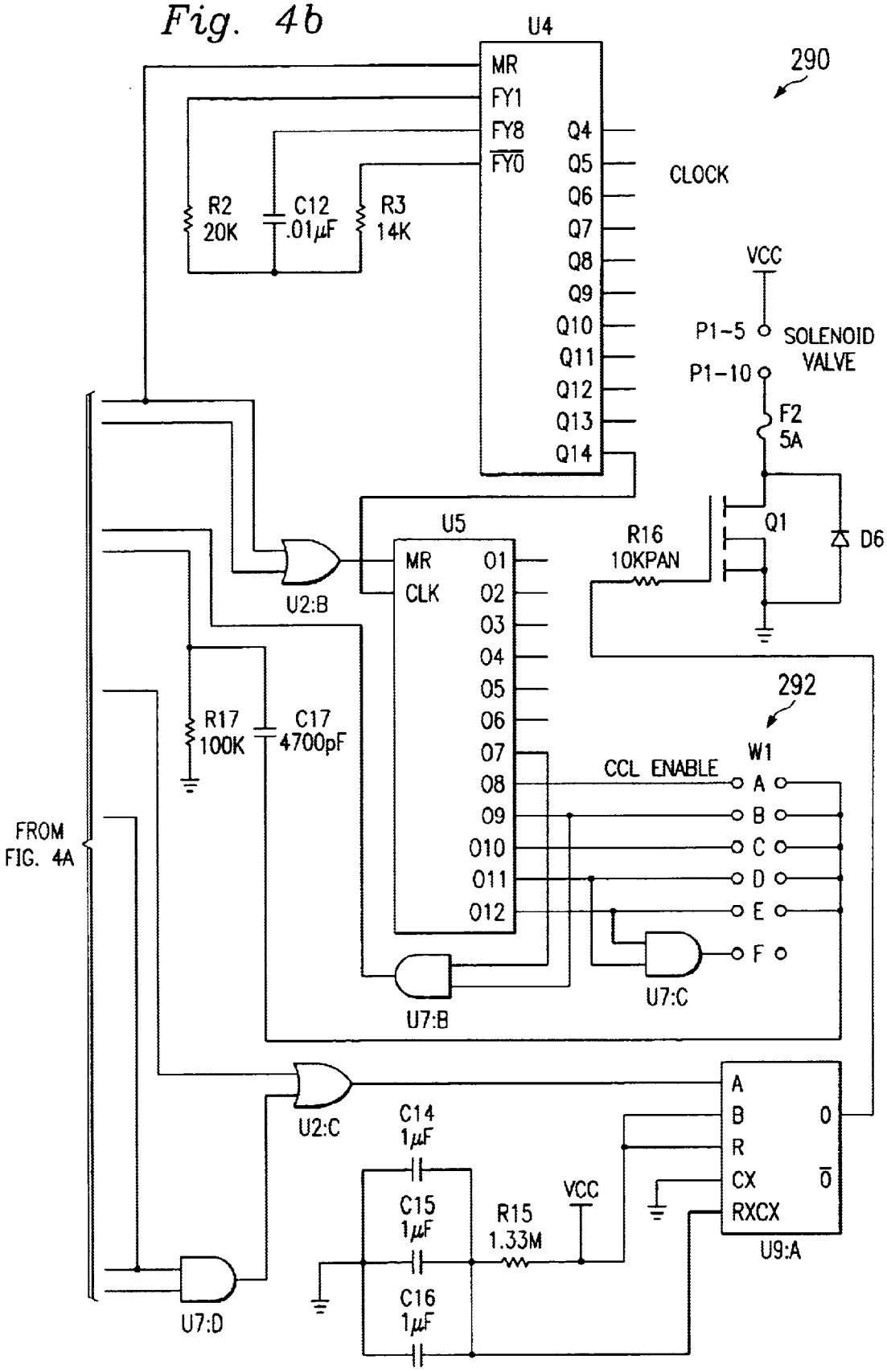

Referring now to FIGS. 4A and 4B, there is presented a schematic of one embodiment of an electrical circuit 290 used by one embodiment of the present invention. In the illustrative embodiment, most of electrical circuit 290 may be on printed circuit board 108. Power for circuit 290 is provided by battery pack 78. For a detailed description of the electrical circuit 290, see U.S. Pat. No. 6,253,842, entitled Wireless Coiled Tubing Joint Locator, which is hereby fully incorporated by reference.

OPERATION OF THE INVENTION

The illustrative embodiment of the present invention operates in three separate modes. In a first mode or "reverse circulation" mode, the embodiment operates in a reverse flow mode to allow for "backwashing" operations within the well annulus 37. In a second mode or "joint logging" mode, the embodiment operates as a conventional joint locator to locate joints and to allow the location of these joints to be recorded. Finally, in a third mode or "fracturing mode" the embodiment allows well fracturing operations to proceed. Each of these modes will be discussed in detail below.

The Reverse Circulation Mode

During well operations, debris often becomes trapped in the coil tubing annulus 37. In order to remove the debris, it may be necessary to pump fluid down the well annulus 37 and up through the production string 20. Such a procedure is known in the art as "reverse circulation."

Referring now to FIG. 5*a,* the direction of fluid during a backwashing operation will initially be downwards along the outside of the joint locator tool 28 in the direction shown by arrows 300*a* and 300*b.* The fluid eventually is pumped back up the tool string and enters the joint locator tool at the opening 233 in an upwardly direction 302. The pressure of the rising fluid will then force the flapper 82 into a substantially vertical position as illustrated in FIG. 5*a,* which will allow the fluid to continue to travel up through the central throughbore 72 and on up the coiled tubing. Although the flapper 82 is used in the illustrated embodiment, it is important to realize that this use is not by way of limitation and other embodiments may use different types of one-way valves.

Joint Logging Mode

Referring to FIG. 1, in all operational modes the joint locator 28 may be attached to the coiled tubing 26 at the top connecting sub 70 as previously described. A well tool 30 may also be connected below joint locator 28 at the bottom sub housing 224. The coiled tubing 26 may be injected into well 10 and may be raised within the well using injector 12 in the known manner with corresponding movement of joint locator 28. Thus, joint locator 28 may be raised and lowered within production string 20.

Figure 2:
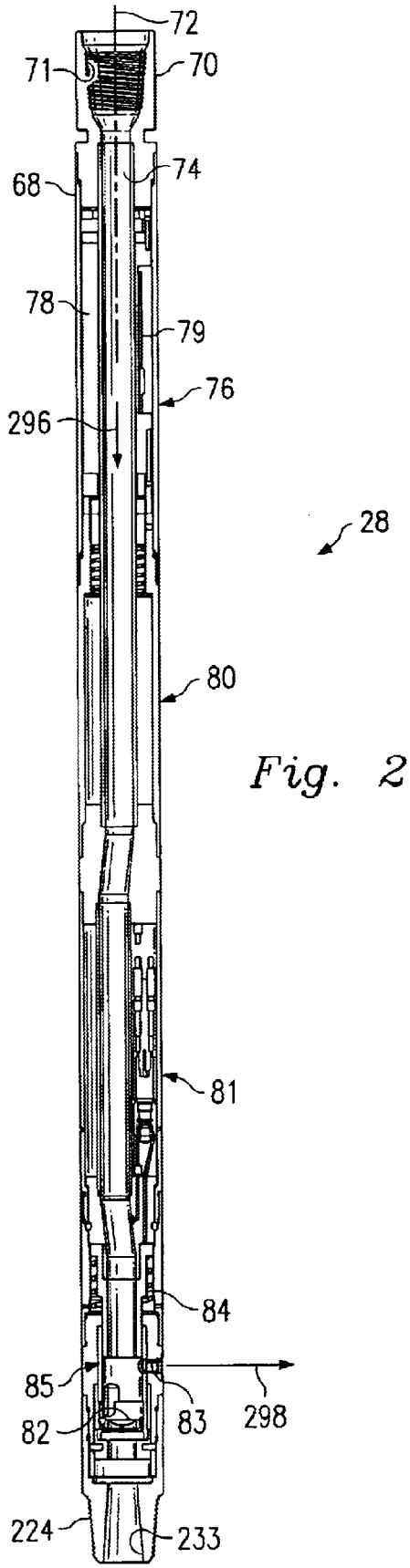
FIG. 2 is a longitudinal cross section of one embodiment of the present invention.

Referring to FIG. 2, when operating in the joint logging mode, the well fluid is pumped down the coiled tubing 26 and enters the joint locator 28 through the top opening 71, as shown by arrow 296. The fluid, therefore flows through the central throughbore 72 until it reaches the flapper 82. In the illustrative embodiment, the flapper 82 is in a horizontal position which prevents fluid from exiting through the opening 233 (FIG. 3*c*). The fluid, therefore, exits through the second passageway or the exit port 83 in a lateral direction, as represented by arrow 298. The flow rate used by one embodiment during the joint logging mode is in the 0.75 to 1.0 barrel/minute range. This pumping rate creates a back-pressure of 300 to 400 psi within the central throughbore 72 of the embodiment.

As joint locator 28 passes through a tubing or casing joint, the change in metal mass disturbs the magnetic field around the electromagnetic coil assembly 130 (FIG. 3*b*). This disturbance induces a small amount of voltage in the coil, and this voltage spike travels to the printed circuit board 108 (FIG. 3*a*). Detection logic on the printed circuit board 108 decides whether the voltage spike is sufficient in size to represent a collar. If the spike is too small, the printed circuit board 108 does not respond to the spike. If the spike is large enough to exceed the threshold on the board, the circuit board allows the battery voltage to be routed to the solenoid valve assembly 132 (FIG. 3*b*).

Once battery power is supplied to solenoid valve assembly 132, the valve portion 184 is actuated by the electric solenoid 182 to place the passageway 186 in communication with the passageway 188 of the lower transition housing sub 161. In the illustrative embodiment, this power is applied to solenoid valve assembly 132 for a period of approximately 2.9 seconds.

Figure 5B:
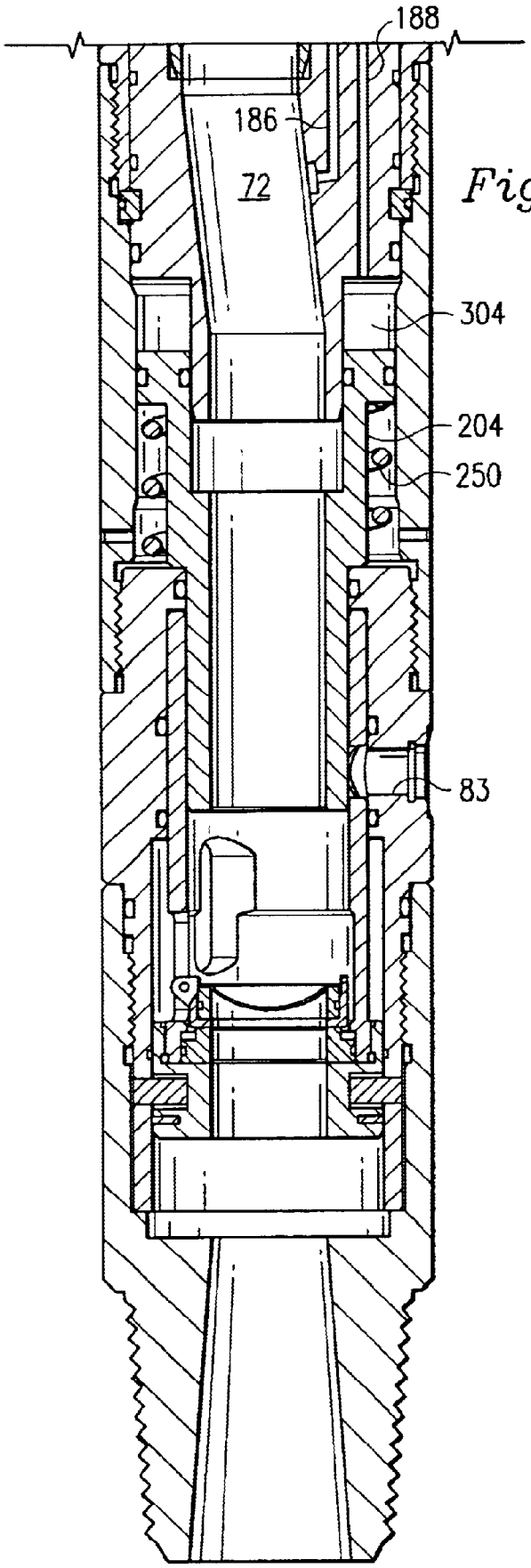
FIG. 5*b* is a longitudinal cross section of the embodiment illustrated in FIG. 3*c* showing the embodiment functioning in a joint logging mode.

Turning now to FIG. 3*c,* the actuation of solenoid valve assembly 132 briefly places the fluid pressure in the central throughbore 72 in communication with the top surface 202 of the piston 204 within the piston housing 208 via the passageways 186 and 188. The fluid pressure in spring chamber 240 is at annulus pressure because of vent ports 254. Therefore, the higher internal pressure of the central throughbore 72 (i.e., in one embodiment, this is about 300 to 400 psi) applied to the top surface 202 of the piston 204 forces the piston 204 downwardly such that it acts as a valve means which covers the exit port 83 in the circulating sub 216. This situation is illustrated in FIG. 5*b* which shows the piston 204 in a downward position to cover access to the exit port 83. This blocking of the exit port 83 causes a surface detectable pressure increase in the fluid in the central throughbore 72 fluid since the fluid no longer flows through the exit port 83. The operator will know the depth of joint locator 28 and thus be able to determine the depth of the pipe joint just detected.

When the solenoid valve assembly 132 recloses, fluid is no longer forced into a piston chamber 304 (defined as the space between the top surface 202 of the piston 204 and the lower surface 200 of the lower transitional housing 161). Fluid in the piston chamber 304 may be forced back-up passageway 188 and exit through the vent ports 190*a* and 190*b*. The spring 250, therefore, will return the piston 204 to its open position which will again allow the fluid to flow through exit port 83.

The piston 204, the spring 250, the fluid passageways 186 and 188, and the solenoid valve assembly 132 comprise one embodiment of the movable cover module of which covers the exit port 83 when a signal is sent from the printed circuit board 108.

It will be understood by those skilled in the art that joint locator 28 may also be configured such that the exit port 83 is normally closed and the momentary actuation of the piston 204 by the solenoid valve assembly 132 may be used to open the exit port. In this configuration, the pipe joint would be detected by a surface detectable drop in the fluid pressure. This process for detecting the location of pipe joints may be repeated as many times as desired to locate any number of pipe joints The only real limitation in this procedure is the life of the power source.

The Fracturing Mode

In order to maximize the amount of oil derived from an oil well a process known as hydraulic pressure stimulation or, more commonly, formation fracturing is often employed. In formation fracturing, fluid is pumped under high pressure down the wellbore through a steel pipe having small perforations in order to create or perpetuate cracks in the adjacent subterranean rock formation.

After the joint logging portion of the job is complete, the tool may be shifted from the joint logging mode to a fracturing mode. This shift may be accomplished by a variety of mechanisms. In the illustrative embodiment, this shift between modes occurs as a result of an increase in fluid pressure caused by an increase in pump rate. However, in other embodiments, the shift could occur as a result of blocking a flow exit port which would also cause an increase in pressure in the central throughbore of the embodiment. For instance, dropping a ball down the coiled tubing 26 and into the central throughbore 72 could block a outlet port which is designed to couple with the ball. Such an action would also cause an increase in fluid pressure which could trigger a shift in operational modes.

In the illustrative embodiment, the joint logging mode is normally conducted at a pump rate of around 1 barrel/minute. After the logging portion is complete, a user can shift to the fracturing mode by increasing the pump rate to a predetermined increased rate, such as 4 barrels/minute. At the increased flow rate, the backpressure in the central throughbore 72 will approach a predetermined pressure, such as 2850 psi.

Figure 5C:
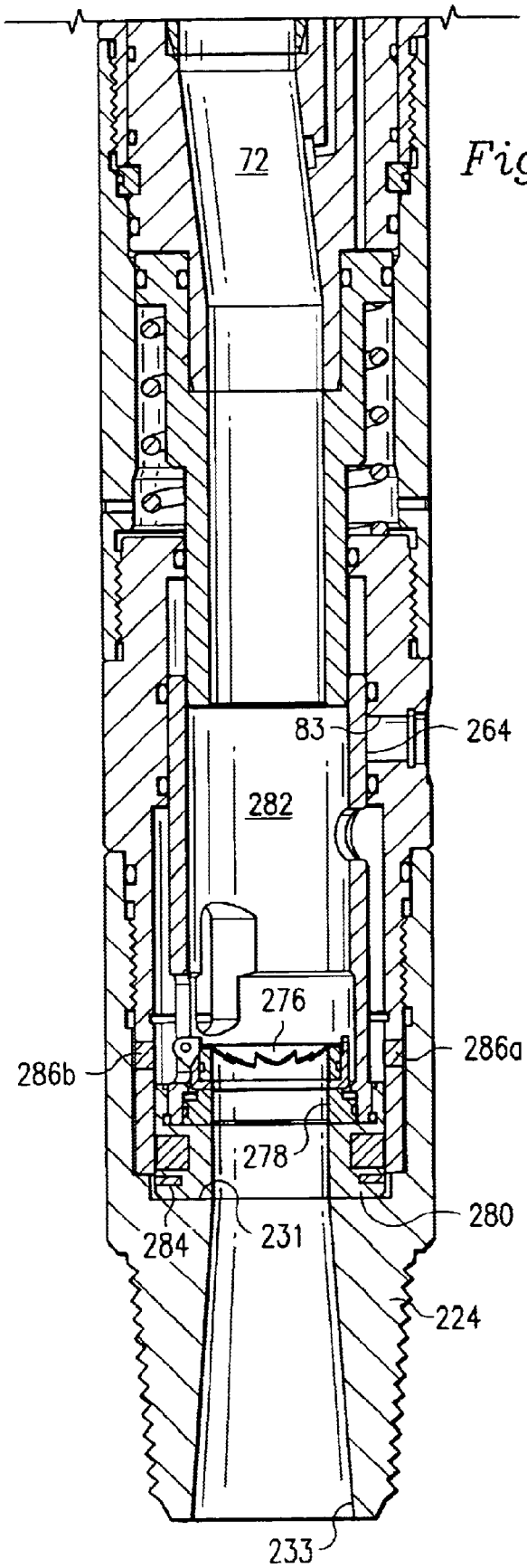
FIG. 5*c* is a longitudinal cross section of the embodiment illustrated in FIG. 3*c* showing the embodiment functioning in fracturing mode.

When the backpressure inside the central throughbore 72 reaches the predetermined pressure, the shear pins 286*a*–286*b* will shear. This shearing allows the fluid pressure to move the flapper sleeve 264, the flapper seat 278, and the flapper seal retainer 280 down the bore 282. Once the flapper seal retainer 280 has moved past lower edge of the circulating sub 216, the snap ring 284 will expand. This expansion will lock the flapper seal retainer 280 in place. Such a condition is illustrated in FIG. 5*c* where the flapper seal retainer 280 is resting on the seat 231 of the bottom sub housing 224. Once the flapper sleeve 264 slides down, the flapper sleeve 264 will then cover the exit port 83. With the exit port 83 covered, continued pumping will create an even greater backpressure. When the back pressure reaches a second predetermined pressure, such as 4500 psi, the rupture disk 276 will rupture, allowing the fluid to exit from the opening 233.

Thus, the entire central throughbore 72 of the illustrated embodiment may be used for fracturing operations. At this point, the illustrated embodiment functions as a conduit for fracturing fluids.

Although only a few exemplary embodiments of this invention have been described in detail above, those skilled in the art will readily appreciate that many modifications are possible in the exemplary embodiments without materially departing from the novel teachings and advantages of this invention. For instance, the collar locator module 76 could employ a giant magnetoresistive "GMR" digital field sensor for electromagnetically sensing the presence of pipe joints. In this alternative embodiment, the GMR device can sense an increase in the mass of a pipe section indicating the presence of a pipe joint as the locator moves through the wellbore. A GMR digital field sensor can then provide a signal to a controller or a circuit board in a manner similar to the illustrative embodiment described above. The GMR digital field sensor, however, is considerably smaller than a magnet/coil assembly and can even be included as a component on a circuit board. Such an embodiment would eliminate the need for a coil and magnet section 80 and allow for a reduced size and weight of the embodiment. Such GMR digital magnetic field sensors are available from Nonvolatile Electronics, Inc. of Eden Prairie, Minn.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A downhole tool for attachment in a production string in a well bore having a casing comprising:

a housing having a first fluid passage and a longitudinal axis;

a valve coupled to the housing, the valve adapted to substantially block a flow of fluid through the first fluid passage in a first direction;

a second fluid passage positioned through the housing in communication with the first fluid passage to permit the flow of fluid to exit through the second fluid passage;

a movable cover module coupled to the first fluid passage such that in response to a first electrical signal the movable cover module substantially blocks the flow of fluid to the second fluid passage; and a flow diverting module positioned within the first fluid flow passage such that in response to an increase in fluid pressure the flow diverting module diverts the flow of fluid from the second fluid passage to the first fluid passage.

2. The downhole tool of claim 1 further comprising a collar locator module coupled to the housing adapted to generate the first electrical signal in response to a detection of a joint in the casing.

3. The downhole tool of claim 2 wherein the collar locator module comprises:

a detection coil wound about the longitudinal axis;

a plurality of magnets coupled to the detection coil and axially disposed about the longitudinal axis of the housing; and a control circuit coupled to the housing in electrical communication with the detection coil, wherein the control circuit determines whether a change in voltage from the detection coil indicates the detection of a joint and generates the first electrical signal when the joint is detected.

4. The downhole tool of claim 2 wherein the collar locator module comprises:

a giant magnetoresistive field sensor; and a control circuit coupled to the housing in electrical communication with the giant magnetoresistive field sensor, wherein the control circuit determines whether a second electrical signal from the giant magnetoresistive field sensor indicates the detection of a joint and generates the first electrical signal when the joint is detected.

5. The downhole tool of claim 1 wherein the valve is adapted to permit the flow of fluid through the first fluid passage in a second direction.

6. The downhole tool of claim 5 wherein the valve comprises a flapper element, hingedly coupled to the first fluid passage such that the flow of fluid in the first direction moves the flapper element to a closed position such that the flapper element substantially blocks the flow of fluid through a portion of the first fluid passage, and the fluid flow in the second direction moves the flapper element to an open position such that the flapper element permits fluid flow through the first fluid passage.

7. The downhole tool of claim 1 wherein the second fluid passage extends transversely through a side of the housing and comprises a nozzle to limit the flow of fluid through the second fluid passage.

8. The downhole tool of claim 1 wherein the movable cover module comprises:

a hollow cylindrical piston disposed longitudinally around the first fluid passage adapted to slidably move between an open position and a closed position, wherein in the closed position the piston covers the second fluid passage to substantially block fluid from entering the second fluid passage;

a spring positioned axially around the piston to exert a longitudinal biasing force upon the piston to normally maintain the piston in the open position;

a third fluid passage in communication with the first fluid passage and the piston; and a solenoid valve coupled to the third fluid passage, wherein the solenoid valve is normally biased to a seat position to close the third fluid passage and in response to the first electrical signal actuates to open the third fluid passage such that fluid pressure in the third fluid passage causes the piston to move from the open position to the closed position.

9. The downhole tool of claim 1 wherein the flow diverting module comprises a hollow cylindrical assembly positioned around the first fluid passage adapted to longitudinally move between an open position and a closed position, wherein in the closed position the cylindrical assembly covers the second fluid passage to substantially block the second fluid passage.

10. The downhole tool of claim 9 further comprising a shear mechanism coupled to the cylindrical assembly and to the housing such that the cylindrical assembly is normally retained by the shear mechanism in the open position, wherein the shear mechanism is shearable at a predetermined force achievable by a first predetermined fluid pressure, wherein when the shear mechanism is sheared the cylindrical assembly is movable from the open position to the closed position.

11. The downhole tool of claim 10 further comprising a rupture disk set to rupture at a second predetermined pressure to allow the flow of fluid through the first fluid passage.

12. The downhole tool of claim 2 further comprising a power source and a time delay circuit for preventing power from being communicated from the power source to the collar locator module and the movable cover module until after a preselected time.

13. The downhole tool of claim 1 wherein the housing comprises an upper end adapted for connection to a length of coiled tubing whereby the tool may be moved within the production string in response to movement of the coiled tubing.

14. The downhole tool of claim 1 wherein the housing comprises a lower end in communication with the first fluid passage, wherein the lower end is adapted for connection to other downhole tools.

15. A downhole tool for attachment in a production string in a well bore comprising:

a means for detecting joints in a casing;

a means for signaling the detection of joints in the casing;

a means for selectively allowing backwashing operations; and a means for selectively allowing fracturing operations.

16. The downhole tool of claim 15 wherein the means for detecting joints further comprises:

an electromagnetic coil means for inducing a magnetic field;

a sensing means for detecting changes in the magnetic field and for sending signals in response to a detection of changes in the magnetic field; and a controller means for determining if the signals indicate the detection of joints in the casing.

17. The downhole tool of claim 15 wherein the means for signaling the detection of joints in the casing comprises:

a means for allowing fluid flow into a first fluid passage within the tool;

a means for selectively allowing the fluid flow in the first fluid passage to flow through an exit port; and a means for selectively increasing fluid pressure within the first fluid passage in response to detection of joints in the casing by stopping the fluid flow through the exit port.

18. The downhole tool of claim 17 wherein the means for selectively allowing backwashing operations comprises a means for allowing fluid flow to enter the first fluid passage via a second fluid passage in response to a change in fluid flow direction.

19. The downhole tool of claim 15 wherein the means for selectively allowing fracturing operations comprises:

a means for allowing fluid flow into a first fluid passage within the tool; and a means for selectively allowing the fluid flow in the first fluid passage to flow through an exit port.

20. A method for fracturing a well having tubing positioned in a well casing, the method comprising:

coupling a joint-locating tool to a lower end of the tubing, the joint-locator tool having a throughbore, a collar locator module, an exit port, a one-way valve, and a mode-switching module;

injecting fluid at a first predetermined rate into the tubing such that the joint-locator tool operates in a joint-locator mode to detect the presence of joints in the well casing;

inducing the mode-switching module to switch from the joint-locator mode to a fracturing mode; and injecting fracturing fluids into the tubing and through the joint-locator tool such that the well can be fractured.

21. The method of claim 20 wherein the inducing step comprises increasing the fluid injection rate to a second predetermined rate to increase pressure within the throughbore such that the mode-switching module switches from the joint-locator mode to the fracturing mode.

22. The method of claim 20 wherein the inducing step comprises plugging a fluid passageway to increase pressure within the throughbore such that the mode-switching module switches from the joint-locator mode to the fracturing mode.

23. The method of claim 20 further comprising injecting fluid between the casing and the tubing to operate the joint-locator tool in a back-washing mode to remove debris in the well.

24. The method of claim 23 further comprising:

injecting the fluid such that the fluid and debris flow into the bottom of a lower end of the throughbore; and moving the one-way valve into an open position to direct the fluid and debris out of an upper end of the throughbore and back up the tubing.

25. The method of claim 20 wherein the injecting fluid step comprises:

injecting the fluid into an upper end of the throughbore; and positioning the one-way valve into a closed position such that fluid entering the throughbore is diverted to the exit port.

26. The method of claim 25 further comprising:

detecting a joint with the collar locator module;

closing the exit port to increase fluid pressure within the throughbore;

recording the increase in fluid pressure to signal the position of the joint; and opening the exit port.

27. The method of claim 20 wherein the inducing step further comprises:

increasing fluid pressure within the throughbore;

shearing a shearing mechanism in response to the increased fluid pressure;

moving a cover to block flow of fluid to the exit port thereby further increasing fluid pressure within the throughbore; and rupturing a rupture disk positioned in the throughbore to allow the fluid to flow through the throughbore.

28. A method for removing debris from a well bore having tubing positioned in well casing, the method comprising:

coupling a joint-locating tool to a lower end of the tubing, the joint-locator tool having a througbore, a fluid ejection port, a collar locator module, a one-way valve, and an exit port;

injecting fluid into the tubing such that the joint-locator tool operates in a joint-locator mode to detect the presence of joints in the well casing; and injecting fluid between the well casing and the tubing to operate the joint-locator tool in a back-washing mode to remove debris in the well.

29. The method of claim 28 wherein the injecting fluid into the tubing step comprises:

injecting the fluid into an upper end of the throughbore; and positioning the one-way valve into a closed position such that fluid entering the throughbore is diverted to the exit port.

30. The method of claim 29 further comprising:

detecting a joint with the collar locator module;

closing the exit port to increase fluid pressure within the throughbore in response to detecting the joint;

recording the increase in fluid pressure to signal the position of the joint; and opening the exit port.

31. The method of claim 28 further comprising:

injecting the fluid such that the fluid and debris flow into a bottom portion of a lower end of the throughbore; and moving the one-way valve to an open position to direct the fluid and debris out of an upper end of the throughbore and back up the tubing.

* * * * *